United States Patent [19]

Steiner et al.

[11] Patent Number: 5,019,004

[45] Date of Patent: May 28, 1991

[54] METHOD OF MANUFACTURING CATHODE RAY TUBES WITH BINARY CODED FACEPLATES

[75] Inventors: Johann Steiner, Des Plaines; John M. Jarosz, Skokie, both of Ill.

[73] Assignee: Zenith Electronics Corporation, Glenview, Ill.

[21] Appl. No.: 458,103

[22] Filed: Dec. 28, 1989

[51] Int. Cl.[5] ..... H01J 1/00

[52] U.S. Cl. ..... 445/30; 445/3; 445/1; 445/45; 220/21 A; 346/140 R

[58] Field of Search ..... 445/30, 45, 1, 3; 427/53.1; 220/2.1 A; 346/140 R; 228/102

[56] References Cited

U.S. PATENT DOCUMENTS 4,514,456 4/1985 Deal et al. ..... 427/53.1
4,692,351 9/1987 Maeda et al. ..... 346/140 R X
4,720,914 1/1988 Maeda et al. ..... 346/140 R X
4,721,488 1/1988 Dougherty et al. ..... 445/30
4,778,427 10/1988 Strauss ..... 445/30
4,791,267 12/1988 Yokoyama et al. ..... 427/53.1 X
4,856,670 8/1989 Hang et al. ..... 220/2.1 A

*Primary Examiner*—Kenneth J. Ramsey

[57] ABSTRACT

A method of manufacturing CRT tubes with binary coded faceplates including dispensing a frit paste on the faceplate in the form of a bar code. The frit is devitrified as part of conventional faceplate processing either during normalizing or during devitrification of the mask rail frit without any additional steps. In one embodiment the frit is dispensed through a single dispensing nozzle and the nozzle is moved relative to the faceplate in x and y coordinates to form a single undulating line. In another embodiment, frit is selectively dispensed through a plurality of nozzles for each character pair to form either narrow bars or wide bars.

13 Claims, 5 Drawing Sheets

METHOD OF MANUFACTURING CATHODE RAY TUBES WITH BINARY CODED FACEPLATES

BACKGROUND OF THE INVENTION

In the manufacture of color cathode ray tubes (CRTs) for the visual displays in television receivers and computers, it is becoming increasingly more important to permanently identify the CRT faceplate. A color cathode ray tube includes a plurality of components including a faceplate with a grille and phosphor screen on its rear surface, a mask with apertures which correspond to the pattern of phosphor dots or lines on the screen, a funnel attached to the faceplate as well as to a neck which supports an electron gun, and a yoke for deflecting the electron beams.

The coding of the faceplate would enable the manufacturer to determine the source of defects and to more easily correct them. For example, it would permit a determination of which machine in the process caused the defects, assuming that the code is also monitored at the machine that caused the defect. These machines would include, for example, the gun sealing station for sealing the gun to the neck, the lighthouse for producing the phosphor dots or lines forming the screen on the rear of the faceplate, the grille machine for applying the grille to the rear of the faceplate, the mask welding machine for welding the mask to the rails in the case of tubes using flat tension mask technology, and a plurality of others.

It would also be desirable to code the masks as well as the faceplates to permit the masks to be separated from the faceplates during manufacture and rejoined at some later step in the manufacturing process without fear of joining the wrong mask to a given faceplate.

As is well known, present commercial CRT technology mandates the dedication of a particular mask to a particular faceplate because the dedicated mask is utilized to generate the phosphor pattern on the faceplate and thus cannot be interchanged. By encoding both the faceplate and the mask, it would be possible to separate them at will during manufacture and to later rejoin them properly.

However, it has heretofore not been commercially practical to code the faceplate because known coding techniques cannot withstand the kiln temperature, on the order of 460 degrees C., required to join the funnel to the faceplate. Conventional coding techniques such as paint spraying or printing methods simply will not hold up at these high kiln temperatures. Also, various acids and caustic wash processes are used that could destroy conventional labels.

It is a primary object of the present invention to provide a method for permanently applying a bar code to CRT faceplates that withstands the rigors of the manufacturing process.

In accordance with the present invention a method of manufacturing CRT tubes with binary coded faceplates is provided including dispensing a frit paste on the faceplate in the form of a bar code. While a USS-1 2/5 bar code is illustrated herein, any other bar code such as Code 39, U. P. C., etc., can be applied by this process. The frit is devitrified as part of the conventional faceplate processing either during faceplate normalization or during devitrification of the mask rail frit in flat tension mask technology without any separate step of devitrifying the code.

In one embodiment of the present invention, frit is dispensed through a single dispensing nozzle and the nozzle is moved relative to the faceplate along x and y coordinates to form a single undulating line. Parallel line portions of this undulating line define the code itself and the lines are joined at their ends by generally semicircular line portions. By utilizing curved line portions as opposed to sharp 90 degree turns at the ends and beginnings of the parallel line portions, considerable time saving is accomplished because the nozzle takes less time to complete these curved line portions than if if followed a rectangular path.

The narrow bars of the 2/5 bar code are formed by a single pass of the nozzle, while the wide bars are formed with a triple nozzle pass.

An important aspect of the present invention is that the code is formed as a negative image to both conserve dispense time and frit because it is then unnecessary to dispense frit in the "quite zone".

In another embodiment of the present invention, frit is selectively dispensed through a plurality of nozzles numbering 18 for each character pair, and 2 start-up and 4 stop bar nozzles, plus 10 nozzles for each of 2 quiet zones if a positive code image is desired.

In both embodiments, however, frit flow is a constant volume flow, produced through the application of pressure. Frit flow is terminated, not by valving the frit paste, but instead by the application of a high negative pressure to the frit at the dispensing nozzle and then a low negative pressure. The switching of these pressures is accomplished with solenoid operated valves. Also in both embodiments, a predetermined distance is maintained between the faceplate and the nozzle tip by a follower stylus carried by a dispensing head and nozzle assembly. The nozzle tip thus follows any curvature of the faceplate.

On curved faceplates, the bar code is usually located on the outer surface of the peripheral faceplate integral flange while in the flat tension mask technology, the bar code would typically be located at a predetermined location on the front face of the panel its edge.

Through the use of the present coding method, it now becomes possible, with code sensing at all stations during the manufacturing process, to identify and isolate a particular machine causing defects in a simple and efficient manner thereby providing far superior quality control than heretofore known in CRT manufacturing technology.

The present faceplate coding technique, when utilized in conjunction with a mask code, permits separate random movement of the faceplate and mask when desired through portions of the manufacturing process and then enables them to be properly remated prior to final assembly. That is, by sensing both faceplate code and mask code at a joining location, the proper mask will be joined to the proper faceplate. This is an extremely important capability in CRT technology today where the mask is dedicated to a specific faceplate through the manufacturing process even though not physically permanently joined together.

Other objects and advantages of the present invention will appear more clearly from the following detailed description.

DETAILED DESCRIPTION OF THE PREFERRED EMBODIMENTS

Figure 1:
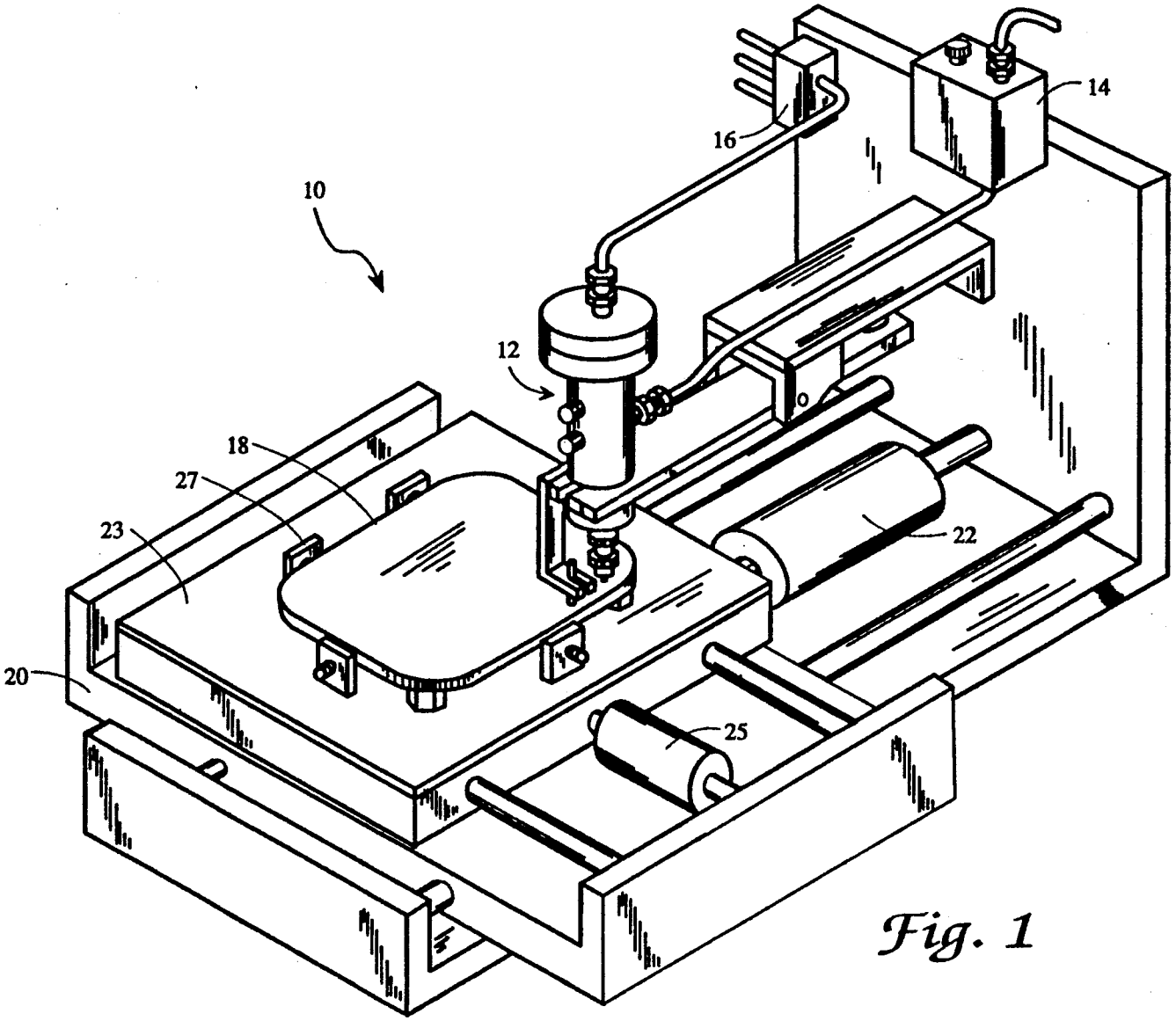
FIG. 1 is a perspective view of a single nozzle bar code frit dispensing machine illustrated applying frit to the forward face of a faceplate suitable for a CRT using a flat tension mask.
Figure 2:
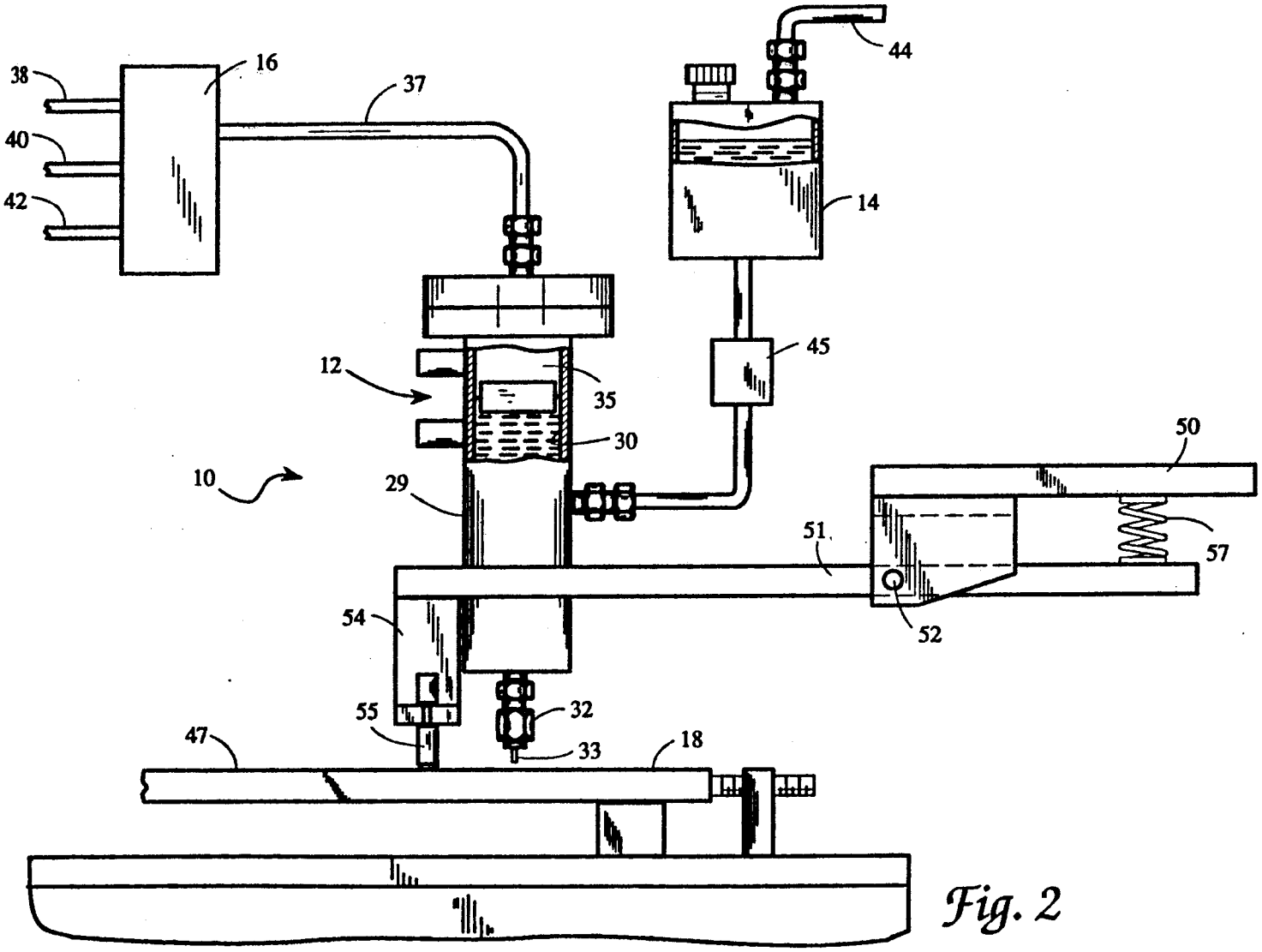
FIG. 2 is a side view of the single nozzle frit dispensing machine illustrated in FIG. 1.

Referring to the drawings and particularly FIGS. 1 and 2, a bar code frit paste applying machine 10 is illustrated that practices one embodiment of the present invention and is seen to generally include a single nozzle frit dispensing unit 12 that receives frit paste from a frit paste reservoir 14 and is controlled by a pressure valve 16, that dispenses frit paste in a continuous line pattern on the forward face of a flat CRT faceplate 18. The faceplate is moved in x and y directions relative to the dispensing unit 12 by an x carriage 20 movable linearly by servo motor 22 and a y carriage 23 movable in an orthogonal direction by servo motor 25. A microprocessor, a program and suitable driving circuitry are provided (not shown) for servo motors 22 and 25 to provide the desired movement to the carriages 20 and 23 to form the desired code pattern on the faceplate 18. The same program and another driver control pressure valve 16 to initiate and terminate the flow of frit paste from dispensing unit 12.

The faceplate 18 is held in a fixed position on the y carriage 23 by a plurality of locating and clamping elements 27.

The dispensing unit 12 includes a cylindrical body 29 that forms a small reservoir 30 communicating with a single lower nozzle assembly 32 having a nozzle tip 33.

Dispensing unit 12 when activated delivers a constant volumetric flow through nozzle tip 33 by the application of a constant positive pressure in upper chamber 35 when valve 16 is positioned to connect line 37 to positive pressure line 38 which is connected to a regulated constant pressure source of compressed air or, if desired, another compressed gas.

Flow from nozzle tip 33 is terminated when valve 16 connects line 37 to line 40 connected to a regulated high negative pressure which in turn produces a high negative pressure in chamber 35 to rapidly cut off flow from nozzle 33 eliminating any dripping problem. Shortly thereafter, on the order of less than 1 second, valve 16 connects line 17 to line 42 which produces a lower negative pressure in chamber 35, and this is sufficient to prevent any dripping from, or air entering through nozzle 33 until valve 16 again connects line 37 to positive pressure line 38 for the next code application cycle on another faceplate.

It should be stated that the flow of frit is controlled without the need for a valve through which frit passes; only air or some other innocuous gas is in contact with valve 16. Abrasion and wear resulting from the frequent opening and closing of a valve filled with frit is thus avoided.

Frit paste reservoir 14 is pressurized through line 44 and delivers paste to reservoir 30 in dispensing unit 12 on demand controlled by valve 45.

An important aspect of the code applying machine 10 and the method according to the present invention is the maintenance of a constant spacing of nozzle tip 33 from the forward face 47 of faceplate 18. Toward this end the machine frame has a cantilevered fixed support 50 that pivotally supports a dispensing unit frame 51 at pivot pin 52. The forward end of frame 51 has a downwardly projecting L-shaped bracket 54 that carries a nonabrasive vertical stylus 55 in close proximity to the nozzle tip 33, engaging faceplate upper surface 47 to maintain the constant spacing. Stylus 55 is adjustable vertically to the desired spacing value. A counterbalance spring 57 is provided between support 50 and the upper surface of the proximal end of frame 51 to relieve some of the pressure or force that stylus 55 exerts on faceplate surface 47.

Figure 3:
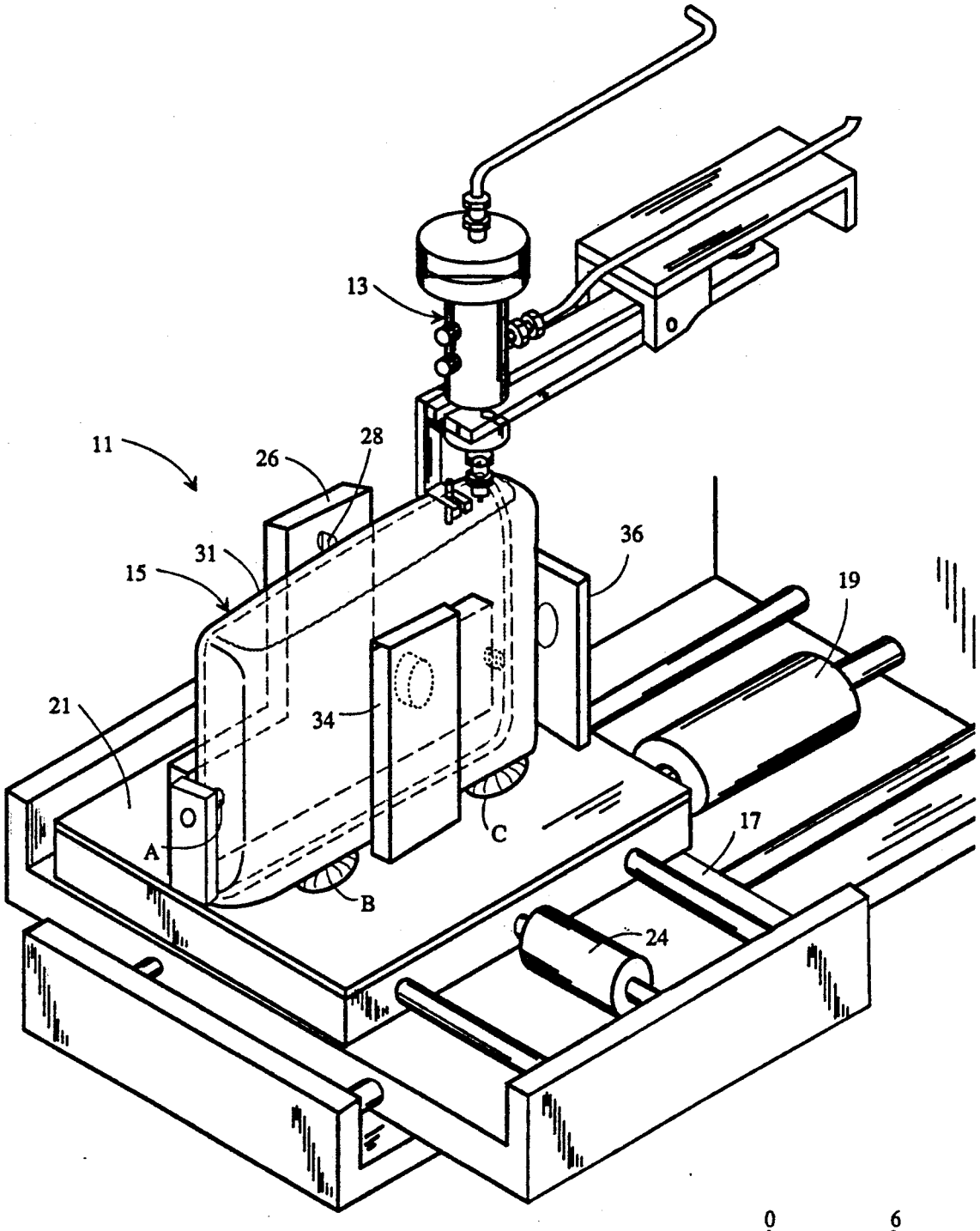
FIG. 3 is a perspective view of a single nozzle bar code frit dispensing machine similar to FIG. 1 illustrated applying frit to a curved television type faceplate.

Referring to FIG. 3, another bar code frit paste applying machine 11 is illustrated similar to the FIGS. 1 and 2 embodiment except particularly designed to code curved face television type faceplates. It generally includes a single nozzle frit dispensing unit 13 that dispenses frit paste in a continuous pattern on the flange of a television type faceplate 15. The faceplate is moved in x and y directions relative to the dispensing unit 13 by an x carriage 17 movable linearily by servo motor 19 and a y carriage 21 movable in an orthogonal direction by servo motor 24.

The dispensing unit 13, x and y carriages 17, 21 and their servo motors and controllers are identical to the FIGS. 1 and 2 embodiment except for the support for holding the faceplate 15 vertically in a fixed reference position. Toward this end an inverted "T" shaped base support 26 is fixed to the y carriage 21 and carries three forwardly projecting locating elements 28 with coplanar end surfaces engagable with the end surface 31 of the faceplate flange.

The y carriage 21 and the faceplate also have cooperating "A, B, C" locators and supports that accurately locate the faceplate within a vertical plane. A front biasing assembly 34 urges the faceplate rearwardly into registration with the rear locating elements 28, and a side biasing assembly 36 urges the faceplate to the left to register the faceplate carried A, B, C elements with the y carriage mounted A, B, C elements.

Figure 4:
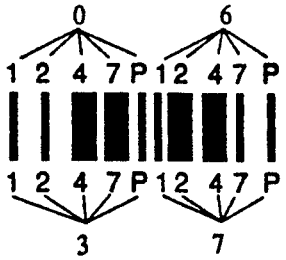
FIG. 4 is the character pair portion of an exemplary USS-1 2/5 standard bar code with descriptive legends.
Figure 5:
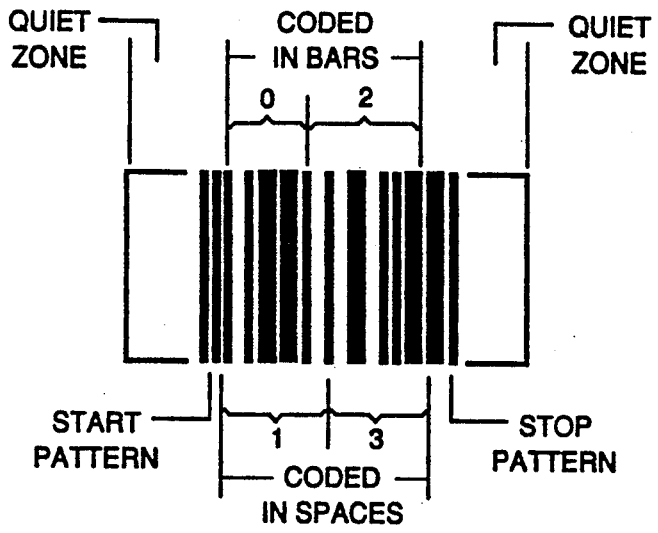
FIG. 5 is a complete USS-1 2/5 bar code.
Figure 7:
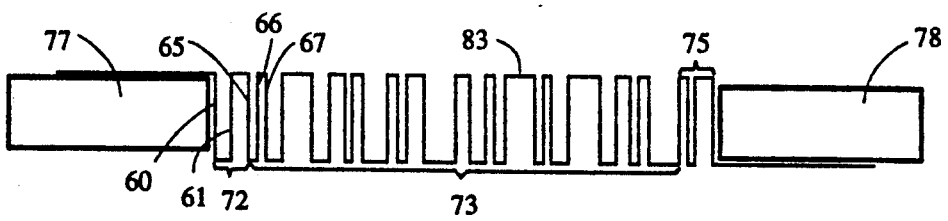
FIGS. 7 and 8 are undulating lines representing the track of the dispensing nozzle in the FIGS. 1 to 6 embodiment.
Figure 8:
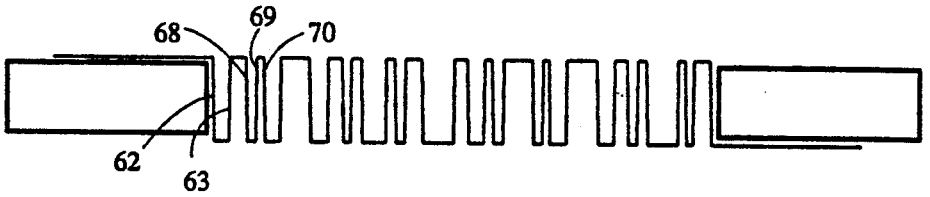

Before turning to the actual encoding illustrated in FIGS. 7 and 8, it is important to understand the basic configuration of the USS-1 2/5 bar code illustrated in FIGS. 4 and 5 which by itself is an industry standard and forms no part of the present invention except that the present method is particularly useful for this type of code.

USS-1 2/5 (originally Interleaved 2-of-5) is a bar code symbology with a numeric character set and different start and stop patterns. The name Interleaved 2-of-5 is derived from the method used to encode pairs of characters. In the symbol, two characters are paired together using bars to represent the first character and spaces to represent the second. USS-1 2/5's characteristics are summarized in Table 1 below.

USS-1 2/5 permits encoding of any length numeric field havig an even number of digits. However, in a specific reader application, the symbols must have a fixed length.

A complete USS-1 2/5 symbol for a number consists of bars or spaces for each character pair enclosed by the special start and stop patterns and quiet zones. For the character set 0 through 9, each character has two wide elements and three narrow elements. The five character elements are represented by bars for the more significant digit of the pair. The character code is derived from a pseudo-binary coded decimal format in which any decimal digit is represented by five binary positions, four weighted bits plus a parity bit, in which only two of the five bits are one. A translation of binary ones and zeroes to respective wide and narrow bar code elements results in two of five elements being wide; this gives rise to the name of the code.

The four-element start pattern and three-element stop pattern bracket the coded numeric data and permit bidirectional decoding of the symbol.

Each symbol is formed from a series of one or more character pairs. Each pair is coded into a series of five bars and five spaces with the bars representing the code for the more significant digit of the pair while the spaces represent the code for the less significant digit. The element pattern for a digit is derived from the weighted position codes listed in Table 1. Reading from left to right the five element positions are weighted according to a 1, 2, 4, 7 and parity value. Except for the zero digit, the sum of the weighted numeric position yields the value of the coded digit. The parity bit is added when necessary to give all codes exactly two non-zero weights. The associated bar code elements are narrow for zero weights and wide for the unit weights.

Since USS-1 2/5 symbols are created from character pairs, the number to be coded must have an even number of digits. Should a number containing an odd number of digits have to be encoded, then a leading zero must be added to produce an even number of digits. For example, the number 367 must be expanded to 0367.

The number to be encoded is first grouped into pairs of adjacent digits proceeding from the most significant to the least significant digit. For example:

0367 yields 03, 67

1265 yields 12, 65

The numeric data of the bar code is formed by placing the symbols for each character pair adjacent to one another with the codes for the most significant character pairs on the left. In each pair of digits the more significant digit is encoded in the bars and the less significant digit is encoded in the spaces.

In the pair of "03", "0" is represented by the bars and "3" is represented by the spaces.

In the pair of "67", "6" is represented by bars and "7" is represented by spaces.

The binary values for each character are shown in Table 1. FIG. 4 illustrates character pair symbols for the pairs "03" and "67" placed adjacent to one another representing the numeric data of the code.

Wide bars and spaces = BINARY 1

Narrow bars and spaces = BINARY 0

Each data character contains 5 binary elements; note 2 of the 5 are binary 1's.

TABLE 1

| DATA | WEIGHTED POSITION | | | |
|---|---|---|---|---|
| CHARACTER 1 | 2 | 4 | 7 | P |
| 0 = 0 | 0 | 1 | 1 | 0 |
| 1 = 1 | 0 | 0 | 0 | 1 |
| 2 = 0 | 1 | 0 | 0 | 1 |
| 3 = 1 | 1 | 0 | 0 | 0 |
| 4 = 0 | 0 | 1 | 0 | 1 |
| 5 = 1 | 0 | 1 | 0 | 0 |
| 6 = 0 | 1 | 1 | 0 | 0 |
| 7 = 0 | 0 | 0 | 1 | 1 |
| 8 = 1 | 0 | 0 | 1 | 0 |
| 9 = 0 | 1 | 0 | 1 | 0 |

Special start and stop patterns are necessary to identify the leading and trailing ends of the bar code symbol. The start pattern consists of four narrow elements beginning with a bar. The stop pattern is a wide bar followed by two narrow elements. The start pattern is positioned at the normal left end of the data symbols adjacent to the most significant digit. The stop pattern is positioned at the normal right end of the data symbols adjacent to the least significant digit.

FIG. 5 illustrates the start and stop patterns and their relationship to the encoded data characters, and the quiet zones. For a negative bar code image the quiet zone is an area that is free and clear of all printing preceding the start pattern and following the stop pattern.

FIG. 5 illustrates a complete bar code for the number 0123.

FIGS. 7 and 8 represent the same character exemplary bar code effected by the machines illustrated in FIGS. 1, 2 and 3 and according to one method of the present invention.

The undulating lines in FIGS. 7 and 8 represent in somewhat diagrammatic style the single continuous line of frit applied by machine 10. It should be understood, however, that the width of the actual frit line dispensed is significantly greater than shown in FIGS. 7 and 8 and in fact is on the order of 0.050 inches. The narrow bars of the code are formed by a single pass frit line so that the narrow bars are also 0.050 inches in width. Such a single pass is represented in FIG. 7, for example, by the single pass narrow start bars 60 and 61 and the corresponding bars 62 and 63 in FIG. 8.

The wide bars of the code are formed by three closely adjacent passes of nozzle 33 indicated by line portions 65, 66 and 67 in FIG. 7 and line portions 68, 69 and 70 in FIG. 8. The resulting frit line from these three passes is approximately 0.120 to 0.150 inches which is the width of the wide bars. Both the FIG. 7 and FIG. 8 codes are seen to be 6 character codes bearing in mind that the codes illustrated in both FIGS. 4 and 5 are four character codes. Thus, in both FIGS. 7 and 8 frit lines 72 form the start pattern, frit lines 73 form the coded in bars and spaces, and frit lines and spaces 75 form the stop pattern. Some codes have 2:1 ratios of wide bars to narrow bars and in such cases the wide bars are formed by two closely adjacent passes of nozzle 33.

When using a negative image code, start quiet zone 77 and stop quiet zone 78 are simply the faceplate background thereby requiring no frit application whatsoever.

Figure 6:
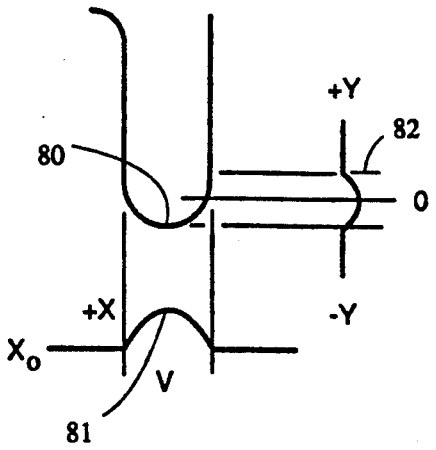
FIG. 6 illustrates x and y axis velocity curves for the preferred bar code illustrated in FIG. 8 with U-shaped interconnections between the bars.

An important aspect of the present method in its preferred form in FIG. 8, is improved dispense time by utilizing arcuate frit line segments 80 shown in FIG. 6 between the bar code line portions. This is achieved by a velocity vector 81 to the x axis servo 22 corresponding to one-half cycle of a sine wave and a velocity vector 82 to the y axis servo 25 corresponding to one-half cycle of a cosine wave. This technique decreases total application time by approximately 30% over the square ended pattern illustrated at 83 in the FIG. 7 code.

Figure 9:
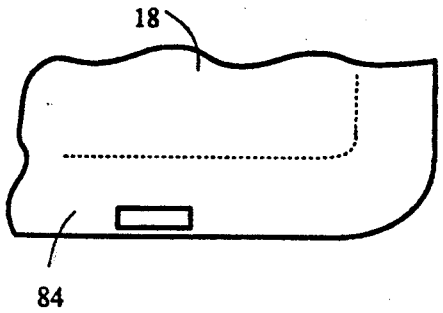
FIG. 9 illustrates an exemplary bar code location on an FTM faceplate.

FIG. 9 illustrates an exemplary location for the bar code on the forward face 84 of flat faceplate 18 immediately adjacent its lower edge.

Figure 10:
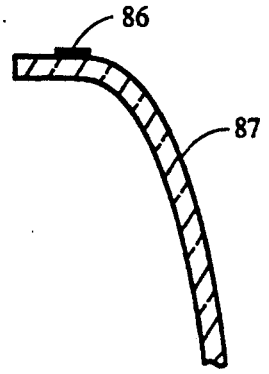
FIG. 10 is a fragmentary section illustrating a preferred location for the bar code on a curved face television panel.

In FIG. 10 bar code 86 is shown on the integral flange of a curved television type faceplate 87, and both of these are exemplary locations for the code.

A variety of frit pastes can be used according to the present method, but one that has been found acceptable is a pigmented glass identified as 42-120 White in L-226 manufactured by the Hommel Company of Carnegie, Pa. chemically named pigmented lead borosilicate from the same chemical family. It contains in varying quantities lead oxide, boron oxide, titanium dioxide, pine oil and ligroin and nonclassified forms of silicates.

Figure 11:
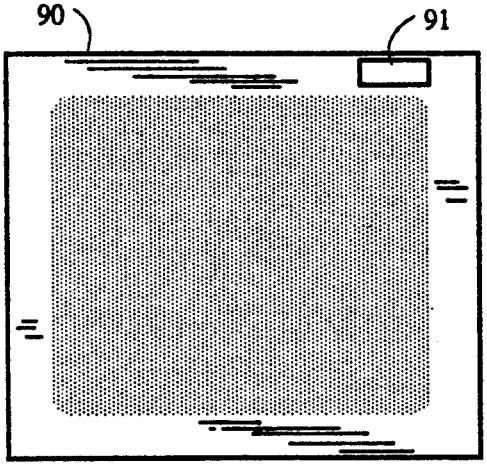
FIG. 11 is a plan view of a flat tension mask with a bar code shown schematically thereon.

When the present method is utilized to assure recombination of masks to faceplates in dedicated mask manufacturing techniques, the mask must be coded and as illustrated in FIG. 11, a mask 90 is shown having a bar code 91 attached thereon. Bar code 91 can be applied either by the frit dispensing machine 10 or a variety of other techniques such as stamping, cutting, or other surface machining techniques.

Figure 12:
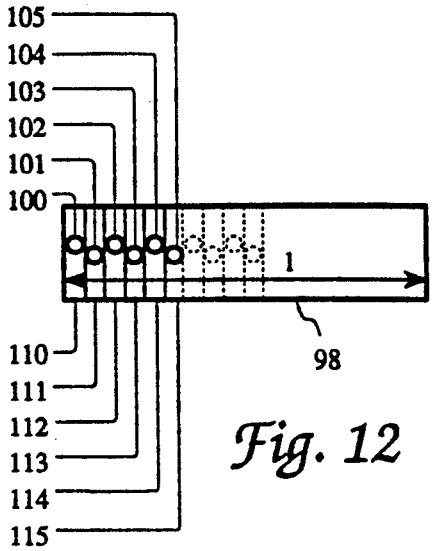
FIG. 12 is a perspective view of a multiple nozzle dispensing head according to another embodiment of the present invention.
Figure 13:
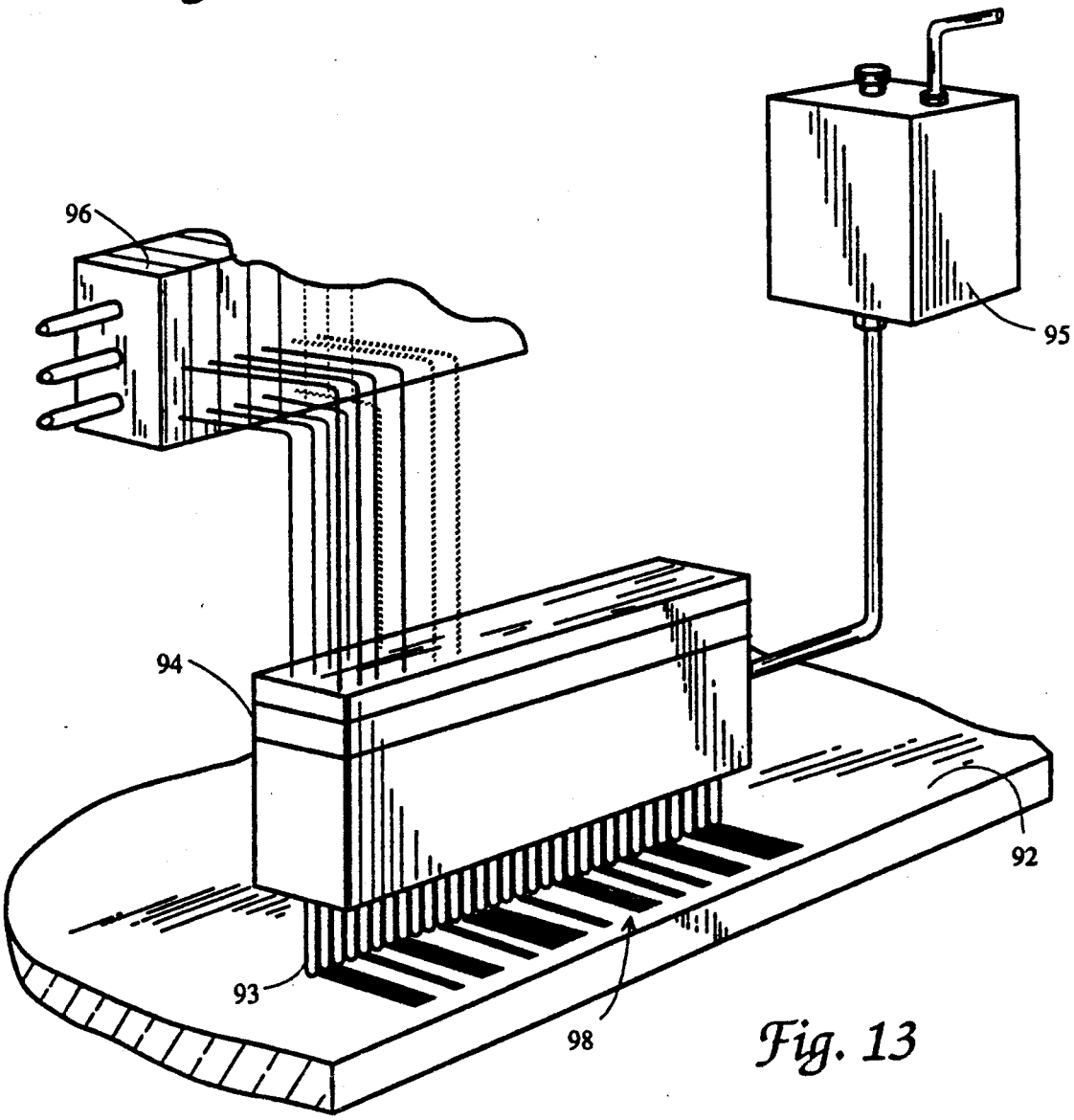
FIG. 13 is a schematic illustration of just a few of the nozzles illustrated in FIG. 12 overlying a portion of an exemplary bar code pattern illustrating the manner of dispensing frit paste to form both the wide and narrow bars and the wide spaces and narrow spaces.

Another embodiment of the present invention is illustrated in FIGS. 12 and 13, and in this method the USS-1 bar code is applied to faceplate 92 by simultaneous single pass delivery through a plurality of adjacent nozzle tips 93 from a single dispensing unit 94, which is fed paste from a reservoir 95, and its frit flow is controlled by a plurality of aligned but separate pressure valves 96. Valves 96 are somewhat diagrammatic and only shown in part but it should be understood that a separate valve is required for each of the nozzles 93 and each is controlled separately.

As seen in FIG. 12, which is a diagrammatic view of nozzles 93 over bar code 98, nozzles 100, 101, 102, 103, 104 and 105 are staggered so that they may be positioned sufficiently close so that any three adjacent nozzles when dispensing paste can form a wide bar in the code pattern. That is, wide bars in the method according to FIGS. 12 and 13, are formed by three somewhat overlapping lines of frit. Narrow bars are formed by shutting off the two nozzles flanking an open one. Wide spaces are formed by shutting off three adjacent nozzles, and narrow spaces are formed by shutting off a single nozzle.

This can be seen more clearly with reference to FIG. 12 where only a part of a full bar code 98 and a few of the nozzles are illustrated in diagrammatic form.

Because in the 2/5 bar code every single character has two of the five binary positions coded binary 1, the horizontal length 1 of the code is always fixed for a given number of character pairs and therefore includes a fixed number of rectangular code areas, 110, 111, 112, 113, 114 and 115 (the remainder have been eliminated simply for clarity in FIG. 12). Each one of the code areas 110 to 115 can be either one-third a wide space, one-third a wide bar, a full narrow space, or a full narrow bar. For this reason there is one nozzle, as shown in FIG. 12, for each of the areas 110 to 115, and each is capable in a given pass of either dispensing frit paste or not. Therefore, each of the nozzles 100 to 105 is separately valved. As in the FIGS. 1 to 8 embodiments, the FIGS. 12 and 13 embodiment is controlled by a suitable program and controlling actuators for each of the nozzles 93 to effect any desired bar code.

It should be understood that certain variations are within the scope of the present method, such as moving the nozzles rather than the faceplate x and y carriages, or moving the single nozzle in one coordinate such the x, and moving the faceplate in the other to have a combined movement creating the code.

What is claimed is:

1. A method of manufacturing cathode ray tubes that have a glass faceplate with a screen applied to its rear surface, a mask with apertures corresponding to a pattern of phosphor deposits on the screen and a funnel that encloses the screen and supports an electron gun, the steps including: applying a frit to the faceplate in the form of a digital code, devitrifying the frit to permanently bond the digital code frit to the faceplate as a devitrified code, applying a screen to the faceplate, attaching a mask in a fixed position relative to the screen, and attaching the funnel to the faceplate by devitrification, said method including dispensing the entire code frit from a single dispensing nozzle, and controlling movement of the dispensing nozzle in an x-y direction relative to the faceplate to form the code frit in a continuous undulating pattern on the faceplate.

2. A method of manufacturing cathode ray tubes as defined in claim 1, including maintaining the nozzle a fixed distance from the faceplate to compensate for faceplate curvature.

3. A method of manufacturing cathode ray tubes as defined in claim 1, wherein the step of controlling movement of the dispensing nozzle includes controlling it to form the code frit in a bar code.

4. A method of manufacturing cathode ray tubes as defined in claim 1, wherein the step of controlling movement of the dispensing nozzle includes repeatedly reversing the direction of relative movement of the nozzle and faceplate to form parallel frit code bars interconnected by "U" shaped ends to increase dispensing speed.

5. A method of manufacturing cathode ray tubes that have a glass faceplate with a screen applied to its rear surface, a mask with apertures corresponding to the pattern of phosphor deposits on the screen and a funnel that encloses the screen and supports an electron gun, the steps including: dispensing frit paste on the faceplate through the application of positive pressure to a dispenser nozzle to draw a code pattern on the faceplate, terminating the dispensing of frit paste through the application of a negative pressure to the dispenser nozzle whereby the use of shut-off valves in the dispenser nozzle is eliminated, devitrifying the frit to permanently bond the digital code frit to the faceplate as a devitrified code, applying a screen to the faceplate, attaching a mask in a fixed position relative to the screen, and attaching the funnel to the faceplate by devitrification.

6. A method of manufacturing cathode ray tubes that have a glass faceplate with a screen applied to its rear surface, a mask with apertures corresponding to the pattern of phosphor deposits on the screen and a funnel that encloses the screen and supports an electron gun, the steps including: simultaneously dispensing frit paste through a plurality of adjacent nozzles and moving the nozzles relative to the faceplate to form a plurality of parallel bars in a bar code position, devitrifying the frit to permanently bond the digital code frit to the faceplate as a devitrified code, applying a screen to the faceplate, attaching a mask in a fixed position relative to the screen, and attaching the funnel to the faceplate by devitrification.

7. A method of manufacturing cathode ray tubes as defined in claim 6, including the steps of dispensing frit paste on the faceplate through the application of positive pressure to a dispenser to form a code pattern on the faceplate, and terminating the dispensing of frit paste through the application of a negative pressure to the dispenser whereby the use of shut-off valves in the dispenser is eliminated.

8. A method of manufacturing cathode ray tubes as defined in claim 6, wherein the step of simultaneously dispensing frit in the faceplate includes forming a bar code including wide bars and narrow bars and wide spaces and narrow spaces representing binary numbers, the step of simultaneously dispensing frit through a plurality of nozzles including selectively dispensing frit paste through either one or both of adjacent pairs of nozzles to form either a narrow bar or a wide bar or a narrow space or a wide space.

9. A method of manufacturing cathode ray tubes as defined in claim 6, wherein the step of devitrifying the frit on the faceplate simultaneously with heating the faceplate in a manufacturing step conventionally necessary in the production of the tube to eliminate an additional step of code frit devitrification.

10. A method of manufacturing cathode ray tubes as defined in claim 6, wherein the step of devitrifying the frit paste includes simultaneously normalizing the faceplate to relieve stress and devitrifying the frit on the faceplate to eliminate an addition step of code devitrification.

11. A method of manufacturing cathode ray tubes as defined in claim 6, wherein the step of devitrifying the frit paste includes applying a frit to the rear surface of the faceplate to form at least a portion of a mask attaching rail, and simultaneously devitrifying the rail frit and the code frit to eliminate an additional step of devitrifying the code frit.

12. A method of manufacturing cathode ray tubes that have a glass faceplate with a screen applied to its rear surface, a mask with apertures corresponding to the pattern of phosphor deposits on the screen and a funnel that encloses the screen and supports an electron gun, the steps including: simultaneously dispensing frit paste through a plurality of adjacent nozzles and moving the nozzles relative to the faceplate to form a plurality of parallel bars in a bar code position, devitrifying the frit to permanently bond the digital code frit to the faceplate as a devitrified code, applying a screen to the faceplate, attaching a mask in a fixed position relative to the screen, and attaching the funnel to the faceplate by devitrification, wherein the step of simultaneously dispensing frit in the faceplate includes forming a USS-1 2/5 bar code including wide bars and narrow bars and wide spaces and narrow spaces representing binary numbers, and the step of simultaneously dispensing frit through a plurality of nozzles includes selectively dispensing frit paste through either one or both of adjacent pairs of nozzles.

13. A method of manufacturing cathode ray tubes that have a glass faceplate with a screen applied to its rear surface, a mask with apertures corresponding to the pattern of phosphor deposits on the screen and a funnel that encloses the screen and supports an electron gun, the steps including: applying a frit to the faceplate in the form of a digital code, devitrifying the frit to permanently bond the digital code frit to the faceplate as a devitrified code, applying a screen to the faceplate, applying a code to the mask prior to permanent attachment relative to the faceplate, further processing the mask and the faceplate separately, sensing the faceplate code and the mask code, and combining the faceplate with the appropriate mask in response to the sensed codes.

* * * * *